US011617427B2

(12) United States Patent
Wojczak

(10) Patent No.: US 11,617,427 B2
(45) **Date of Patent: *Apr. 4, 2023**

(54) HAIR CLIP

(71) Applicant: CONAIR CORPORATION, Stamford, CT (US)

(72) Inventor: Sophia Wojczak, Harrison, NY (US)

(73) Assignee: Conair LLC, Stamford, CT (US)

( * ) Notice: Subject to any disclaimer, the term of this patent is extended or adjusted under 35 U.S.C. 154(b) by 329 days.

This patent is subject to a terminal disclaimer.

(21) Appl. No.: 16/682,945

(22) Filed: Nov. 13, 2019

(65) Prior Publication Data

US 2021/0137237 A1 May 13, 2021

(51) Int. Cl.
*A45D 8/20* (2006.01)

(52) U.S. Cl.
CPC ..... *A45D 8/20* (2013.01)

(58) Field of Classification Search
CPC ... A45D 6/16; A45D 8/20; A45D 8/24; Y10T 24/44444; Y10T 24/44453; D06F 71/40
See application file for complete search history.

(56) References Cited

U.S. PATENT DOCUMENTS 855,874 A * 6/1907 Blobel ..... B42F 9/001 281/45
919,933 A 4/1909 Nowack et al.
1,836,899 A 12/1931 Cahn
1,893,281 A 1/1933 Goodman
D89,782 S 5/1933 Meshko
1,936,838 A 11/1933 Hermsdorf
(Continued)

FOREIGN PATENT DOCUMENTS

FR 2585222 A1 1/1987
GB 814008 5/1959
(Continued)

OTHER PUBLICATIONS

Traceless No Bend Hair Clips Barrettes [online], [site visited Dec. 3, 2020]. Available from internet, URL:<https://www.walmart.ca/en/ip/Traceless-No-Bend-Hair-Clips-Barrettes-Curl-Clip-Makeup-No-Crease-Hair-Clip-Hair-Styling-Bank-Clips-Plating-Silver/1VB2EIZK9CUY> (Year: 2020).
(Continued)

*Primary Examiner* — Nicholas D Lucchesi
*Assistant Examiner* — Jennifer Gill
(74) *Attorney, Agent, or Firm* — Ruggiero McAllister & McMahon LLC

(57) ABSTRACT

A hair clip includes a first paddle extending from a first tab. The first paddle has at least a portion with a width that is greater than a width of the first tab. A second paddle extends from a second tab. The second paddle has at least a portion with a width that is greater than a width of the second tab. The second tab is connected to the first tab. A biasing element is disposed between the first tab and the second tab. The biasing element applies a biasing force to both the first and second paddles such that in a rest position, the first and second paddles are in a closed position, and, in a use position, a first force is applied to the first tab and a second force is applied to the second tab such that the first tab and second tab are moved closer to one another and the first and second paddles are moved further apart from one another than in the rest position.

11 Claims, 7 Drawing Sheets

(56) References Cited

U.S. PATENT DOCUMENTS

| | | | | | |
|---|---|---|---|---|---|
| 2,160,346 | A | | 5/1939 | Valentine | |
| 2,410,106 | A | | 10/1946 | Ryenolds | |
| D148,461 | S | | 1/1948 | D'Alberto | |
| 2,459,926 | A | * | 1/1949 | Benedetto | A45D 8/20 132/277 |
| 2,549,193 | A | | 4/1951 | Grison | |
| 2,659,379 | A | | 11/1953 | Caserta | |
| 2,689,996 | A | | 9/1954 | Glattes | |
| 2,730,111 | A | | 1/1956 | Solomon | |
| 2,929,166 | A | * | 3/1960 | Sneide | A01K 97/00 294/99.2 |
| 3,105,501 | A | * | 10/1963 | Scotti | A45D 20/00 132/212 |
| D203,095 | S | | 11/1965 | Schroeder | |
| 3,223,095 | A | * | 12/1965 | Seekings | A45D 8/20 132/277 |
| 3,545,052 | A | | 12/1970 | Goodman | |
| 3,608,565 | A | | 9/1971 | Ensign | |
| 3,780,402 | A | * | 12/1973 | Takabayashi | F16B 2/10 24/507 |
| 4,554,934 | A | * | 11/1985 | Mooneyhan | A45D 8/24 132/245 |
| D292,327 | S | | 10/1987 | Kalichman | |
| 5,054,226 | A | * | 10/1991 | Hart | A01K 97/18 294/16 |
| D338,983 | S | | 8/1993 | Crafts | |
| 5,494,060 | A | | 2/1996 | Potut | |
| 5,735,296 | A | | 4/1998 | Chen | |
| D415,312 | S | | 10/1999 | Yasuda | |
| 6,135,123 | A | * | 10/2000 | Grassi | A45D 8/24 132/214 |
| 6,209,549 | B1 | * | 4/2001 | Lunde | A45D 8/20 132/277 |
| 6,408,859 | B1 | | 6/2002 | Shyu | |
| D464,465 | S | | 10/2002 | Yasuda | |
| 6,536,446 | B2 | * | 3/2003 | Kimura | A45D 8/20 132/277 |
| 7,044,141 | B2 | | 5/2006 | Yasuda | |
| D592,803 | S | | 5/2009 | Tsai | |
| D640,829 | S | | 6/2011 | Tsai | |
| D656,274 | S | | 3/2012 | Tsai | |
| 8,240,318 | B2 | | 8/2012 | Choi | |
| D884,275 | S | | 5/2020 | Park | |
| D925,123 | S | * | 7/2021 | Hinds | D28/40 |
| 2004/0154633 | A1 | | 8/2004 | Rogers et al. | |
| 2006/0225763 | A1 | | 10/2006 | Lau | |
| 2010/0319722 | A1 | | 12/2010 | Hsu | |
| 2011/0023905 | A1 | | 2/2011 | Choi | |
| 2014/0202489 | A1 | | 7/2014 | Yang | |
| 2017/0172274 | A1 | | 6/2017 | Tsai | |
| 2017/0181518 | A1 | * | 6/2017 | Hsu | B29C 45/2626 |

FOREIGN PATENT DOCUMENTS

| | | | |
|---|---|---|---|
| JP | 3585852 | B2 | 4/2004 |
| JP | 2002-165629 | A | 12/2010 |
| JP | 3166615 | U | 5/2011 |
| JP | 2012-400 | A | 1/2012 |
| JP | 5723574 | B2 | 5/2015 |
| JP | 3207291 | U | 11/2016 |
| KR | 301000572.0000 | | 3/2019 |
| TW | 2004-06165 | A | 5/2004 |
| WO | 2004/039201 | A1 | 5/2004 |
| WO | 2013/033045 | A1 | 3/2013 |

OTHER PUBLICATIONS

13 Pieces No Bend Hair Clips [online], [site visited Dec. 3, 2020]. Available from internet, URL:<https://www.amazon.com/Pieces-Clips-Crease-Makeup-Hairstyling/dp/B0818TH68Y/ref=sr_1_9?dchild=1&keywords=no+crease+hair+clips&qid=1606956596&sr=8-16> (Year: 2020).

4pcs Rhinestone No Bend Hair Clips [online], [site visited Dec. 3, 2020], Available from internet, URL:<https://www.amazon.com/Rhinestone-Styling-Barrette-Hairslyle-Application/dp/B08L6L3YX34/ref-sr_1_16?dchild-1&keywords-no+crease+hair+clips&qid=1606956596&sr=8-16> (Year: 2020).

International Search Report dated Jan. 14, 2021 from corresponding International Patent Application No. PCT/US2020/053959, 3 pages.

Written Opinion dated Jan. 14, 2021 from corresponding International Patent Application No. PCT/US2020/053959, 4 pages.

* cited by examiner

HAIR CLIP

BACKGROUND OF THE DISCLOSURE

1. Field of the Disclosure

The present disclosure is directed to a hair clip. More particularly, the present disclosure relates to a double paddle hair clip.

2. Description of the Related Art

Generally, clips are used during hair styling to hold certain tufts of hair out of the way, or to hold a styled section of hair in place for a predetermined time during styling or post-styling of hair. Such conventional clips have metal frames on one or both sides of an alligator type clip so that a user squeezes distal or lever ends to open jaws of the clip and releases the ends to allow a spring force to close the jaws together. On some types of hair, the metal frame of the clip undesirably results in indentations in the hair from the metal pressing directly against the hair.

Accordingly, there is a need for a clip that does not result in indentations in the hair.

SUMMARY

The present disclosure provides a single hair clip that has a substantially greater surface area that results in lower localized stress concentrations (and thus less likelihood of leaving indentation/damage to hair) and simultaneously can hold a larger tuft of hair (i.e., more individual hairs).

In an embodiment of the present disclosure, a hair clip is provided having a pair of flat, relatively wide paddles.

An embodiment of the hair clip of the present disclosure includes a first paddle and a second paddle. The first paddle extends from a first tab and has at least a portion with a width that is greater than a width of the first tab. The second paddle extends from a second tab and has at least a portion with a width that is greater than a width of the second tab. The second tab is connected to the first tab, and a biasing element is disposed between the first tab and the second tab. The biasing element applies a biasing force to both the first and second paddles so that in a rest position, the first and second paddles are in a closed position. In a use position, a first force is applied to the first tab and a second force is applied to the second tab so that the first tab and second tab are moved closer to one another and the first and second paddles are moved further apart from one another than in the rest position.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF THE DISCLOSURE

Figure 1:
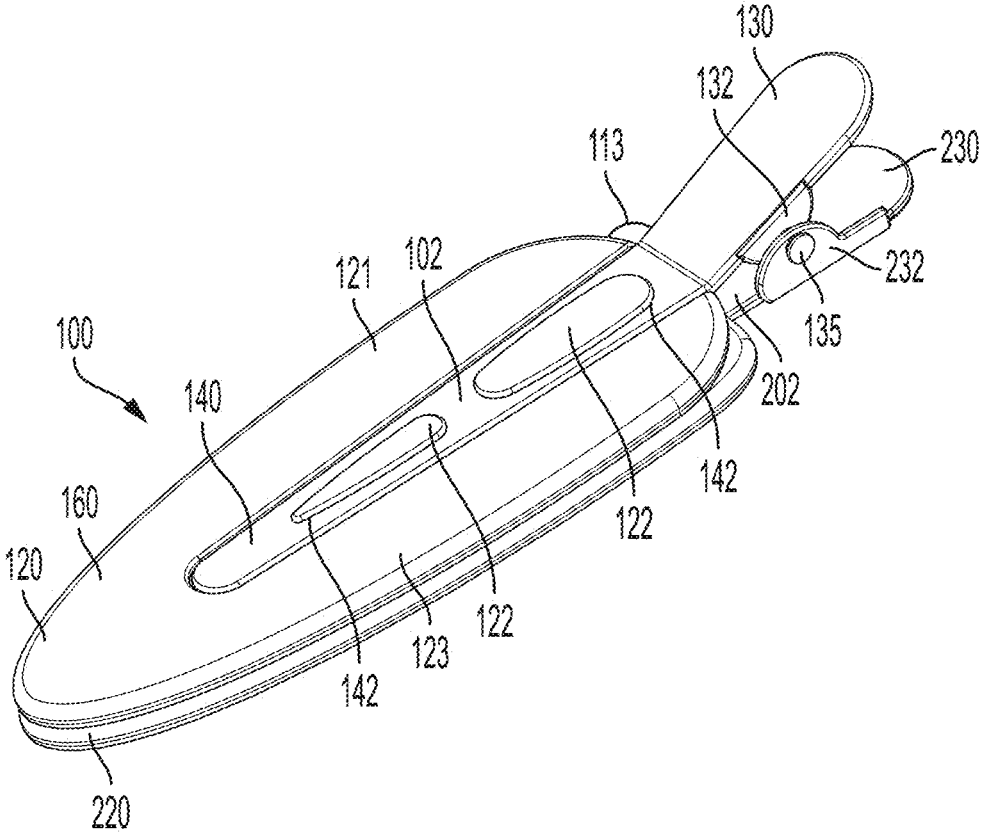
FIG. 1 is a perspective view of a hair clip according to the present disclosure in rest position.

A hair clip 100 according to the present disclosure is shown in FIG. 1. Hair clip 100 is used during hair styling to hold tufts of hair out of the way, or to hold a styled section of hair in place for a predetermined time during styling or post-styling while a style sets.

Hair clip 100 has a first member 102 and a second member 202. First member 102 has a first tab 130 and a first body portion 140 that extends from first tab 130. First tab 130 is at an angle 113 that is less than 180 degrees relative to first body portion 140. First body portion 140 is connected to a first paddle 120. First paddle 120 is connected to first body portion 140, for example, by molding. This molding can be achieved by portions of material 122 of first body portion 140 passing through apertures 142 through first body portion 140 so that portions of material 122 have a size greater than apertures 142 thereby preventing disconnection of first paddle 120 from first body portion 140. A first exterior surface 160 of first paddle 120 has portions 121 and 123 that extend on opposite sides of first body portion 140 so that first paddle 120 has a substantially greater surface area than first body portion 140. First body portion 140 is in a depression in first exterior surface 160 of first paddle 120. Alternatively, first paddle 120 can connect directly to first tab 130 so hair clip 100 has no first body portion 140. Another alternative is first paddle 120 and first tab 130 being a single one-piece structure so that hair clip 100 has no first body portion 140.

First paddle 120 is made of a material that is more flexible than a material of first member 102. First paddle 120 is a medium to medium-soft hardness plastic material with some ability to deform (thereby decreasing stress concentrations/indentations). However, first paddle 120 can be made of any one of a variety of materials. First member 102 is made of metal or other supportive material.

Figure 2:
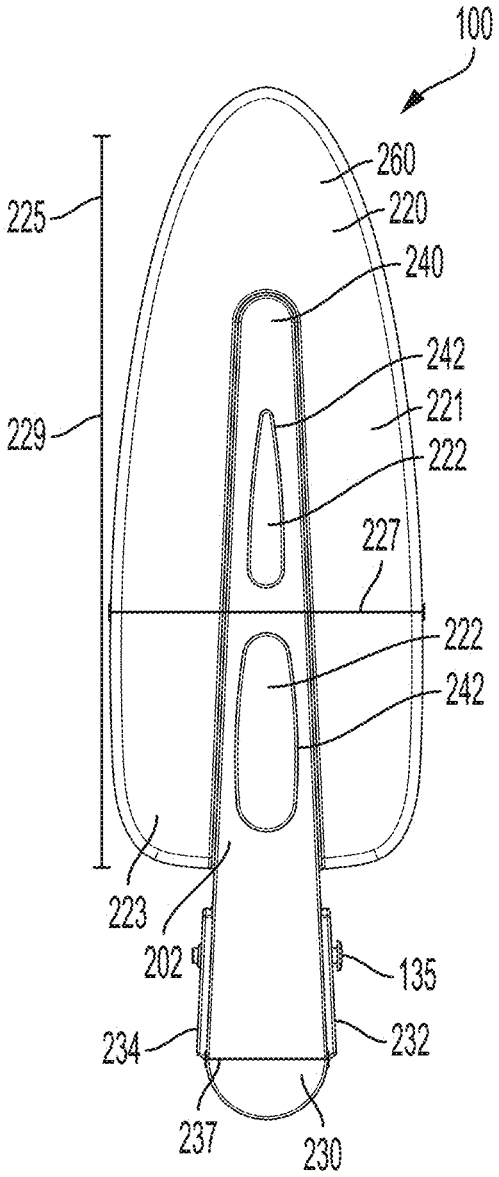
FIG. 2 is a bottom view of the hair clip of FIG. 1.

Referring to FIG. 2, analogous to first member 102, second member 202 has a first tab 230 and a second body portion 240 that extends from second tab 230. Second tab 230 is at an angle that is 180 degrees relative to second body portion 240. Second body portion 240 is connected to a second paddle 220. Second paddle 220 is connected to second body portion 240, for example, by molding. This molding can be achieved by portions of material 222 of second body portion 240 passing through apertures 242 through second body portion 240 so that portions of material 222 have a size greater than apertures 242 thereby preventing disconnection of second paddle 220 from second body portion 240. A second exterior surface 260 of second paddle 220 has portions 221 and 223 that extend extends on opposite sides of second body portion 240 so that second paddle 220 has a substantially greater surface area than second body portion 240. Second body portion 240 is in a depression in second exterior surface 260 of second paddle 220. Alternatively, second paddle 220 can connect directly to second tab 230 so hair clip 100 has no second body portion 240. Another alternative is second paddle 220 and second tab 230 being a single one-piece structure so that hair clip 100 has no second body portion 240.

Analogous to first paddle 120, second paddle 220 is made of a material that is more flexible than the material of second member 202. Second paddle 220 is a medium to medium-soft hardness plastic material with some ability to deform (thereby decreasing stress concentrations/indentations), but can be any one of a variety of materials. Second member 202 is metal or other supportive material.

Figure 4:
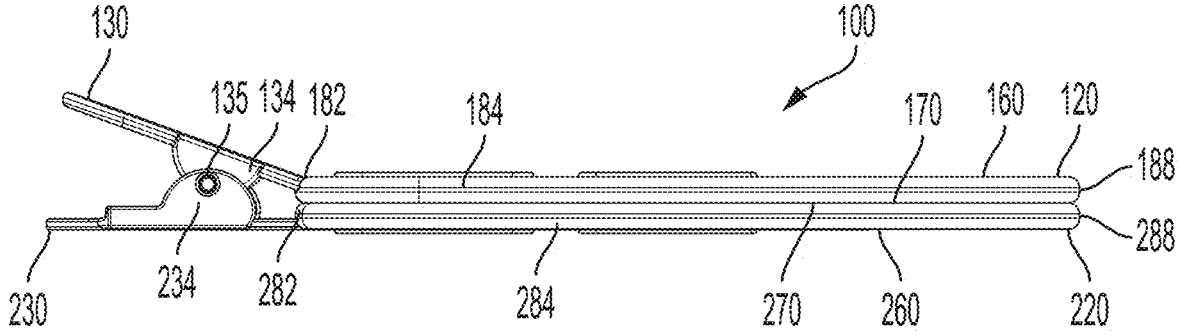
FIG. 4 is a side view of the hair clip of FIG. 1.

Referring to FIGS. 1, 2 and 4, first tab 130 has a first pair of spaced walls 132, 134 (wall 134 is shown in FIG. 4) that extend toward second tab 230. Second tab 230 has a second pair of spaced walls 232, 234 (wall 234 is shown in FIG. 2) that extend toward first tab 130. A pin 135 passes through each of first pair of spaced walls 132, 134 and second pair of spaced walls 232, 234 so that first paddle 120 and second paddle 220 can pivot toward and away from one another.

Figure 3:
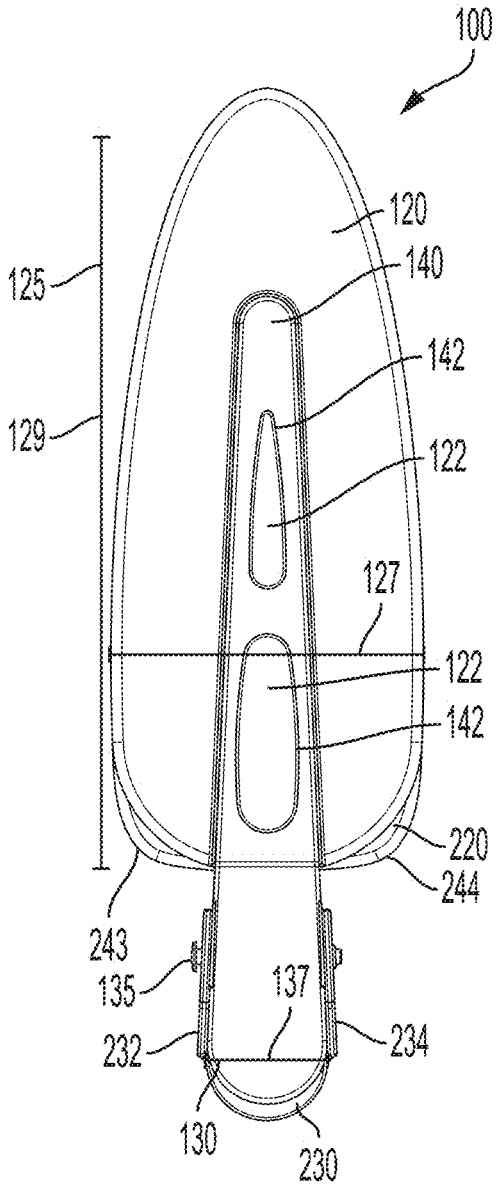
FIG. 3 is a top view of the hair clip of FIG. 1.

Referring to FIG. 3, first paddle 120 has at least a portion 125 with a width 127 that is greater than a width 137 of first tab 130. Portion 125 is a majority of first paddle 120 and can be a length 129. Width 127 can taper away from first tab 130.

Likewise, referring back to FIG. 2, second paddle 220 has at least a portion 225 with a width 227 that is greater than a width 237 of second tab 230. Portion 225 is a majority of second paddle 220 and can be a length 229. Width 227 can taper away from second tab 230.

First paddle 120 and second paddle 220 can be the same shape. Further, first paddle 120 and second paddle 220 can each have a portion that are the same shape as one another, or each have a different shape. First paddle 120 and second paddle 220 shown in FIG. 1 have a portion that are the same shape as one another. In particular, first paddle 120 and second paddle 220 shown in FIG. 1 have the same shape so that first paddle 120 and second paddle 220 overlap except for corners 243, 244 of second paddle 220 that extend beyond first paddle 120. First paddle 120 and second paddle 220 can be symmetrical.

Figure 8:
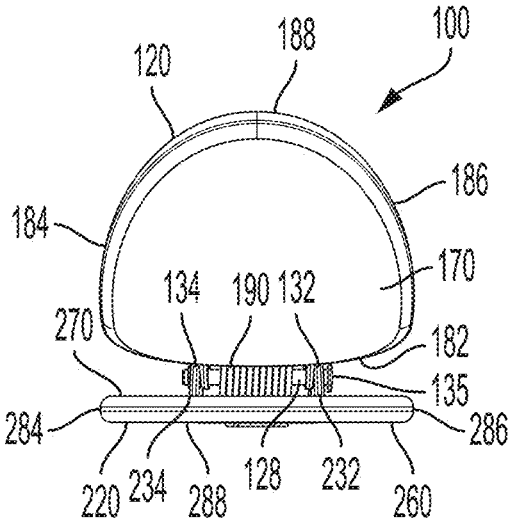
FIG. 8 is a front view of FIG. 6.

Referring to FIGS. 4 and 8, first paddle 120 has exterior surface 160 opposite a first interior surface 170. First paddle 120 forms a first proximal edge 182 opposite a first distal edge 188 and two first side edges 184, 186 opposite one another between first exterior surface 160 and first interior surface 170. Two first side edges 184, 186 each extend between first proximal edge 182 and first distal edge 188. First interior surface 170 is flat.

Second paddle 220 has a second exterior surface 260 opposite a second interior surface 270. Second paddle 220 forms a second proximal edge 282 opposite a second distal edge 288 and two second side edges 284, 286 opposite one another between second exterior surface 260 and second interior surface 270. The two second side edges 284, 286 each extend between second proximal edge 282 and second distal edge 288. Second interior surface 270 is flat and faces first interior surface 170.

Figure 5:
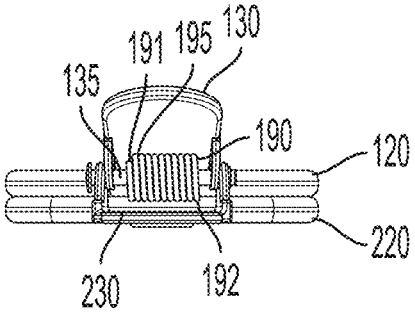
FIG. 5 is a rear view of the hair clip of FIG. 1.

Referring to FIG. 5, a biasing element 190 is disposed between first tab 130 and second tab 230. Biasing element 190 is a spring that is held between first tab 130 and second tab 230 by pin 135 that is threaded through a center of a coil 195 of the spring of biasing element 190. Biasing member 190 has opposite ends so a first end 191 abuts first tab 130 and a second end 192 abuts second tab 230. Alternatively, biasing element 190 is another member that biases first tab 130 away from second tab 230. Biasing element 190 applies a biasing force that biases first tab 130 away from second tab 230 so that first tab 130 applies a biasing force to first paddle 120 and second tab 230 applies a biasing force to second paddle 220 urging first interior surface 170 of first paddle 120 and second interior surface 270 of second paddle 220 together so that in a rest position, first paddle 120 and second paddle 220 are in a closed position, as shown in FIGS. 1-5.

Figure 6:
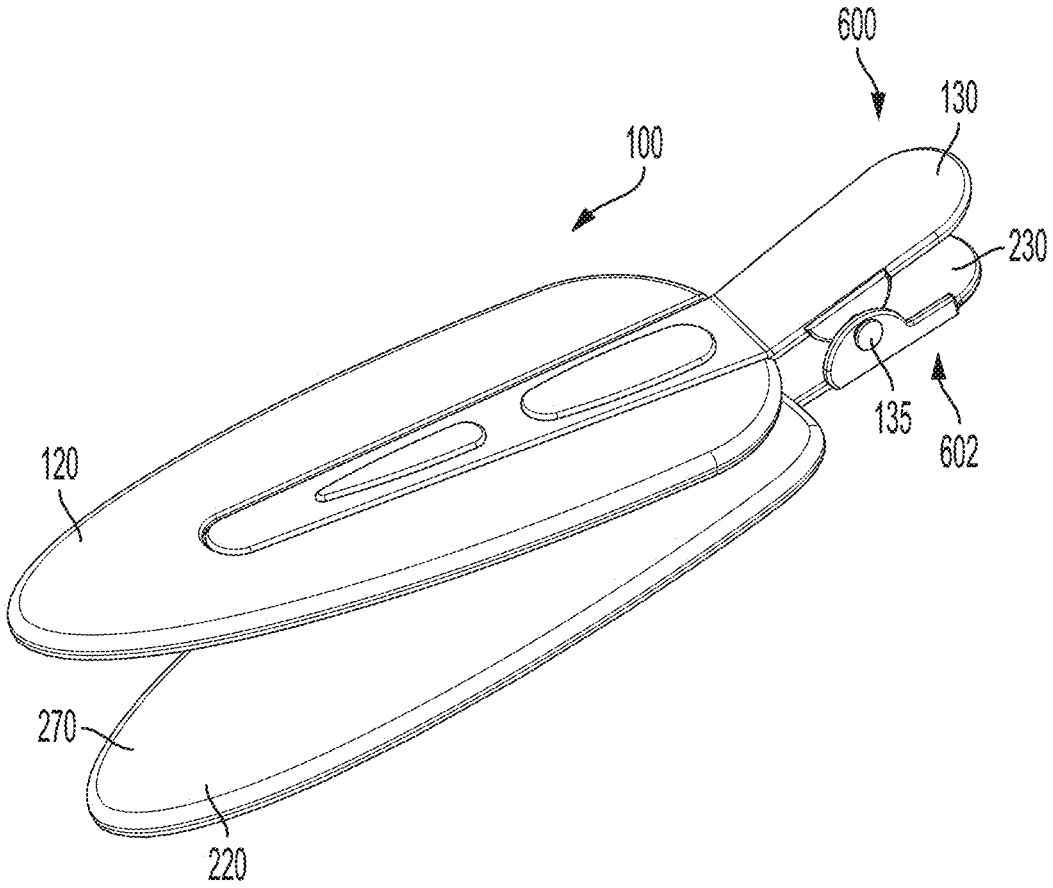
FIG. 6 is a perspective view of the hair clip in a use position.
Figure 7:
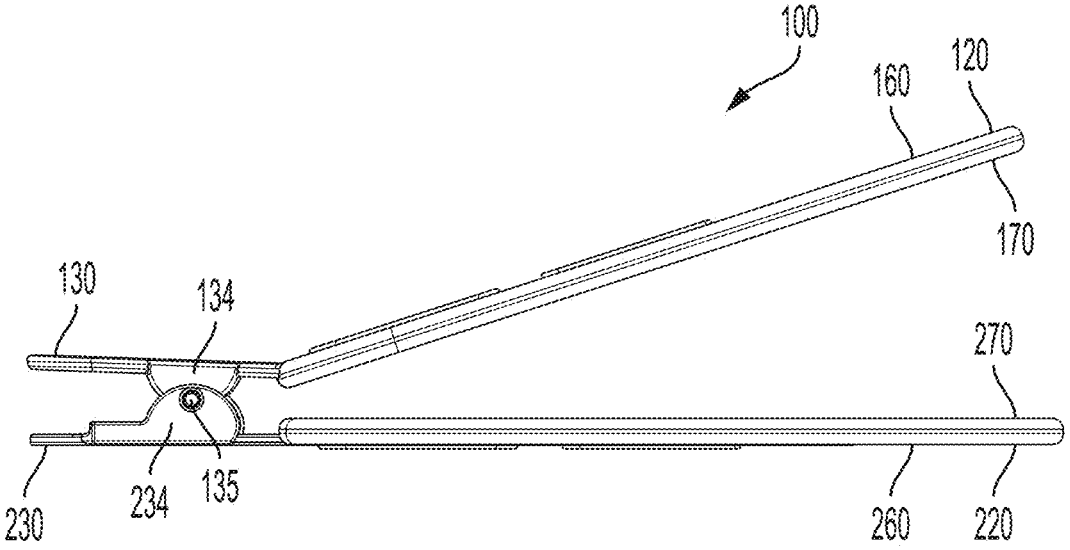
FIG. 7 is a side view of FIG. 6.

FIGS. 6-8 show a use position, where a first force is applied in a direction 600 to first tab 130 and a second force is applied in a direction 602 to second tab 230 so that first tab 130 and second tab 230 overcome the bias of biasing member 190 and move closer to one another, while first paddle 120 and second paddle 220 move apart from one another more than in the rest position shown in FIG. 1. In particular, the first force applied in direction 600 to first tab 130 and the second force is applied in a direction 602 to second tab 230 moves first tab 130 and second tab 230 so that each pivot about pin 135 closer to one another and first tab 130 moves first paddle 120 away from second paddle 220 and second tab 230 moves second paddle 220 away from first paddle 120. While hair clip 100 is in the use position, a user can place hair in between first interior surface 170 of first paddle 120 and second interior surface 270 of second paddle 220. The user can then release the first force applied in direction 600 to first tab 130 and the second force is applied in direction 602 to second tab 230 so that the bias of biasing member 190 moves first tab 130 and second tab 230 to each pivot about pin 135 away from one another and first tab 130 moves first paddle 120 closer to second paddle 220 and second tab 230 moves second paddle 220 closer to first paddle 120 clamping hair between first paddle 120 and second paddle 220. The metal frame of biasing member 190, pin 135, first member 102 and second member 202 forms a spring-loaded, alligator type clip. When a user squeezes the lever or distal ends, namely, first tab 130 and second tab 230, first paddle 120 and second paddle 220 open. The lever ends, namely, first tab 130 and second tab 230, are released to let the spring of biasing member 190 force the jaws, including first paddle 120 and second paddle 220, shut.

First paddle 120 and second paddle 220 minimize or prevent indentations in hair from metal frames found in conventional hair clips that press directly against the hair. In particular, first paddle 120 and second paddle 220 of the present clip 100 minimize or prevent metal-to-hair contact that would normally be applied if a hair clip, like conventionally hair clips, does not have a pair of analogous mating paddles. For example, if hair clip 100 only had one paddle, on some types of hair, the side of hair clip without a paddle (the paddle-less side) would result in indentations in the hair from the metal of the body, while the side of hair clip with the paddle (the paddled side) would have no indentations.

Clip 100 with first paddle 120 and second paddle 220 prevent metal-to-hair contact. Further, the flat, wide shape of first paddle 120 and second paddle 220 have a substantially greater surface area (than the paddle-less side of conventional clips) resulting in lower localized stress concentrations (and thus less likelihood of leaving indentation/damage to hair) and yet holds a larger tuft of hair (i.e., more individual hairs) in a single clip.

As stated previously, the material of first paddle 120 and second paddle 220, respectively, is preferably a medium to medium-soft hardness plastic material with some ability to deform (thereby decreasing stress concentrations/indentations), but can be any one of a variety of materials. Further, the "surfboard" shape shown in FIGS. 1-8 of each of first paddle 120 and second paddle 220 is preferred for its reduced profile distal tip which makes it easy to maneuver, but the disclosure is not limited thereto. Also, while the preferred embodiment shows symmetry between first paddle 120 and second paddle 220, first paddle 120 and second paddle 220 do not need to correspond exactly to each other in size and shape.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A hair clip comprising:

a first member having a first tab and a first body portion that extends from the first tab, the first body portion being directly connected to a first paddle, the first paddle having at least a portion with a width that is greater than a width of the first body portion, the first body portion being flat;

a second member having a second tab and a second body portion that extends from the second tab, the second body portion being directly connected to a second paddle, the second paddle having at least a portion with a width that is greater than a width of the second body portion, the second body portion being flat, the second tab being connected to the first tab, the first and second paddles being a material that is more flexible than a material of the first and second members; and a biasing element disposed between the first tab and the second tab, the biasing element applying a biasing force to the first and second paddles so that in a rest position, the first and second paddles are in a closed position so that the first paddle contacts the second paddle, and, in a use position, a first force is applied to the first tab and a second force is applied to the second tab so that the first tab and second tab are moved closer to one another and the first and second paddles are moved further apart from one another than in the rest position, wherein the first paddle has a first exterior surface opposite a first interior surface, wherein the first paddle forms a first proximal edge opposite a first distal edge and two first side edges opposite one another between the first exterior surface and the first interior surface, wherein the two first side edges each extend between the first proximal edge and the first distal edge, the first proximal edge, the first distal edge and the two first side edges are each single edges, wherein the second paddle has a second exterior surface opposite a second interior surface, wherein the second paddle forms a second proximal edge opposite a second distal edge and two second side edges opposite one another between the second exterior surface and the second interior surface, and wherein the two second side edges each extend between the second proximal edge and the second distal edge, the second proximal edge, the second distal edge and the two second side edges are each single edges, and wherein the shape of the first paddle has a substantially greater surface area than the first body portion and the shape of the second paddle has a substantially greater surface area than the second body portion resulting in lower localized stress concentrations and holding larger tufts of hair than the first body portion and the second body portion without the first paddle and the second paddle; wherein the first interior surface is flat and the second interior surface is flat and faces the first interior surface; wherein the first distal edge is asymmetrically shaped relative to the first proximal edge and wherein the second distal edge is asymmetrically shaped relative to the second proximal edge.

2. The hair clip of claim 1, wherein the first and second paddles taper in shape away from the first and second tabs, respectively.

3. The hair clip of claim 1, wherein the first tab has a first pair of spaced walls that extend toward the second tab, and wherein the second tab has a second pair of spaced walls that extend toward the first tab.

4. The hair clip of claim 3, further comprising a pin that passes through each of the first pair of spaced walls and the second pair of spaced walls so that the first paddle and the second paddle can pivot toward and away from one another.

5. The hair clip of claim 1, wherein the first tab is at an angle that is less than 180 degrees relative to the first paddle.

6. The hair clip of claim 5, wherein the second tab is at an angle that is 180 degrees relative to the second paddle.

7. The hair clip of claim 1, wherein the first paddle and the second paddle each have a portion that are the same shape.

8. The hair clip of claim 1, wherein the first and second paddles are symmetrical.

9. The hair clip of claim 1, wherein the first paddle is a surfboard shape.

10. The hair clip of claim 9, wherein the second paddle is a surfboard shape.

11. The hair clip of claim 1, wherein the first and second paddles are a medium to medium-soft hardness plastic material with some ability to deform.

* * * * *